United States Patent [19]

Atkins et al.

[11] 4,426,539

[45] Jan. 17, 1984

[54] SYNTHESIS OF THE ISOMERIC AMINOTETRANITROTOLUENES

[75] Inventors: Ronald L. Atkins; William P. Norris; Arnold T. Nielsen; Richard A. Hollins; William S. Wilson, all of Ridgecrest, Calif.

[73] Assignee: The United States of America as represented by the Secretary of the Navy, Washington, D.C.

[21] Appl. No.: 377,119

[22] Filed: May 11, 1982

[51] Int. Cl.[3] ..... C07C 43/20

[52] U.S. Cl. ..... 564/441; 149/92; 149/105

[58] Field of Search ..... 564/441; 149/92, 105

[56] References Cited

U.S. PATENT DOCUMENTS 2,347,660 5/1944 Burtle ..... 260/577

*Primary Examiner*—Charles F. Warren

*Assistant Examiner*—Margaret B. Medley

*Attorney, Agent, or Firm*—R. F. Beers; W. Thom Skeer; Roger F. Phillips

[57] ABSTRACT

Aminopolynitrotoluenes, having energetic properties, including 4-amino-2,3,5,6-tetranitrotoluene 3-amino-2,4,5,6-tetranitrotoluene and 2-amino-3,4,5,6-tetranitrotoluene, and methods for their preparation. Also, 4-amino-N,2,3,6-tetranitrotoluene and 4-amino-N-2,3,5,6-pentanitrotoluene, each having energetic properties. Further, a process for preparing 2,3,4,5,6-pentanitrotoluene.

7 Claims, No Drawings

SYNTHESIS OF THE ISOMERIC AMINOTETRANITROTOLUENES

BACKGROUND OF THE INVENTION

1. Field of the Invention

This invention relates to methods for preparing aryl compounds having a multiplicity of nitro groups attached, and to novel substituted aryl compounds produced by those methods. More specifically this invention relates to novel aminopolynitrotoluene compounds and methods for their preparation.

2. Description of the Prior Art

Aryl compounds substituted with large numbers of nitro groups are well known to be explosives. Typical examples are 2,4,6-trinitrotoluene commonly known as TNT, and 1,3,5-trinitrobenzene. TNT is particularly known to be of great utility as an explosive. These compounds are prepared by direct nitration of the aromatic nucleus with nitric acid, usually in solution with concentrated sulfuric acid or oleum. These procedures allow a maximum of only three nitro groups to be introduced into the aromatic nucleus. Substitution of the remaining positions would allow more energy to be incorporated in the molecule. Prior art techniques could not perform this desired function.

SUMMARY OF THE INVENTION

According to this invention novel aminotetranitrotoluenes, aryl compounds with four nitro groups introduced into the aromatic nucleus, are prepared, according to a preferred embodiment, by nitration of an appropriate aminodinitrotoluene precursor in mixed acid solution, followed by treatment with anisole. The inventive compounds are more energetic than TNT while imparting other desirable properties to explosives made therewith, such as high density, good thermal and chemical stability, stability towards impact and shock initiation, and improved detonation properties including detonation velocity and detonation pressure.

DESCRIPTION OF THE PREFERRED EMBODIMENT 4-amino-2,3,5,6-tetranitrotoluene was prepared in 35% yield by carrying out the procedure set forth in the following specific examples:

EXAMPLE 1

4-amino-N,2,3,6-tetranitrotoluene. To a stirred solution of 600 mg (3 mmol) of 4-amino-2,6-dinitrotoluene in a mixture of 12 ml of glacial acetic acid and 36 ml of 96% sulfuric acid in an ice bath was added dropwise 1.8 ml of 90% nitric acid in 12 ml of glacial acetic acid. After stirring at 0° C. for 5 h the mixture was placed in a freezer overnight (1°–10° C.) and then stirred at 0° C. the following morning for an additional 4 h. The mixture was extracted with methylene chloride (4×50 ml) and the combined extracts washed with water (2×100 ml), dried over anhydrous magnesium sulfate and evaporated at a reduced pressure giving 680 mg of 4-amino-N,2,3,6-tetranitrotoluene as a pale yellow oil, which, due to its instability, was used immediately without purification in the next step: IR (KBr), 3350 (NH) and 1630 $cm^{-1}$ ($NO_2$); NMR ($(CD_3)_2CO$), δ8.53 (S, 1, ArH) and 2.57 (S, 3, $CH_3$).

4-amino-2,3,5,6-tetranitrotoluene. The crude product of the above reaction (680 mg) was dissolved in 100 ml of 96% sulfuric acid and maintained at 0° C. for about $2\frac{1}{2}$ days. The solution was then poured over ice (200–300 g) and the resulting mixture extracted with methylene chloride (2×150 ml) and chloroform (2×150 ml). The combined extracts were dried over anhydrous magnesium sulfate and evaporated to give a yellow solid. Recrystallization from chloroform-hexane gave 310 mg of the desired compound as yellow needles: m.p. 230°–5° C.; IR (KBr), 3320 (NH) and 1640 $cm^1$ ($NO_2$); NMR ($CDCl_3$) δ7.6 (br S, 2, $NH_2$) and 2.15 (S, 3,$CH_3$).

Anal. calcd. for $C_7H_5N_5O_8$: C, 29.26; H, 1.76; N, 24.38. Found: C, 29.10; H, 1.71; N, 24.16.

The product was identified by standard laboratory techniques as 4-amino-2,3,5,6-tetranitrotoluene.

An alternate and much improved procedure for the synthesis of 4-amino-2,3,5,6-tetranitrotoluene in 78% yield is set forth in the following specific example:

EXAMPLE 2

4-amino-2,3,5,6-tetranitrotoluene. One gram of 4-amino-2,6-dinitrotoluene was dissolved in 40 ml of 96% sulfuric acid. The reaction solution was cooled to 5° C. With stirring, 3 ml of 90% nitric acid was added dropwise over 10 minutes maintaining the temperature below 10° C. The reaction mixture was packed in ice and stirred overnight (16 h). The resulting yellow suspension was extracted with methylene chloride (3×100 ml). The yellow solution was dried over anhydrous magnesium sulfate and evaporated to give 1.44 g (100%) of fine yellow solid. IR and NMR spectra showed this to be 4-amino-N,2,3,5,6-pentanitrotoluene.

The 4-amino-N,2,3,5,6-pentanitroluene was suspended in 25 ml of 96% sulfuric acid, and 0.5 ml of anisole was added. The reaction suspension turned very dark. The resulting suspension was stirred at room temperature for 30 minutes, extracted with methylene chloride (3×100 ml), dried over anhydrous magnesium sulfate and evaporated to give 1.14 g of fine yellow solid (78% yield). Recrystallization from 25 ml of methylene chloride gave fine yellow needles. Spectral data, nmr, ir, mass spec, and elemental analyses confirmed the structure.

3-amino-2,4,5,6-tetranitrotoluene was prepared in 46% yield by carrying out the procedure set forth in the following specific example:

EXAMPLE 3

3-amino-2,4,5,6-tetranitrotoluene. To a solution of 1 g (5.1 mmol) of 3-amino-2,5-dinitrotoluene in 30 ml of 96% sulfuric acid was added dropwise 3 ml of 90% nitric acid and the mixture stirred at room temperature for 3 h. The mixture was extracted with methylene chloride (4×50 ml) and the combined extracts were dried over anhydrous magnesium sulfate and evaporated to give 3-amino-N,2,4,5,6-pentanitrotoluene as a pale yellow oil. This oil was redissolved in 150 ml of 96% sulfuric acid, 1 g of anisole was added and the solution stirred at room temperature for 1 h. The mixture was extracted with methylene chloride (4×100 ml), and the combined extracts dried over anhydrous magnesium sulfate and evaporated to a yellow solid.

Recrystallization from chloroform (washed with sulfuric acid and distilled) gave 665 mg (46%) of yellow needles: m.p. 192°–3° C.; IR (KBr), 3470 and 3370 (NH) and 1630 $cm^{-1}$ ($NO_2$); NMR $CDCl_3$), δ6.85 (br S, 2, $NH_2$) and 2.53 (S, 3, $CH_3$).

Anal. calcd. for $C_7H_5N_5O_8$: C, 29.26; H, 1.74; N, 24.38. Found: C, 29.34; H, 1.71; N, 24.25.

2-amino-3,4,5,6-tetranitrotoluene was prepared in 22% yield by carrying out the procedure set forth in the following specific example:

EXAMPLE 4

2-amino-3,4,5,6-tetranitrotoluene. 2-amino-4,6-dinitrotoluene (3.0 g; 0.015 moles) was dissolved in 96% sulfuric acid (150 ml) at room temperature. 100% nitric acid (1.92 g; 0.030 moles) was added dropwise with stirring, and the reaction mixture was stirred for 24 h under ambient conditions. The reaction mixture was extracted with methylene chloride (5×100 ml), and the extract was dried over anhydrous magnesium sulfate and evaporated to dryness to leave 0.95 g (22%) crude product. Recrystallization from methylene chloride (ca 50 ml) gave 2-amino-3,4,5,6-tetranitrotoluene as yellow crystals (0.60 g), m.p. 183°–185° (dec); IR (KBr), 3450 and 3330 (NH) and 1620 $cm^{-1}$ ($NO_2$); NMR ($(CD_3)_2CO$), δ8.20 (br S, 2, $NH_2$) and 2.45 (S, 3, $CH_3$).

Anal. calcd. for $C_7H_5N_5O_8$: C, 29.26; H, 1.74; N, 24.38. Found: C, 29.25; H, 1.66; N, 24.14.

2-amino-3,4,5,6-tetranitrotoluene was prepared in 48% yield by carrying out the procedure set forth in the following specific example:

EXAMPLE 5

2-amino-3,4,5,6-tetranitrotoluene. 2-amino-4,6-dinitrotoluene (1.0 g; 0.008 moles) was dissolved in 80% sulfuric acid (50 ml) at room temperature. 100% nitric acid (1.28 g; 0.020 moles) was added dropwise and with stirring, and the reaction mixture was stirred for 24 h under ambient conditions. The yellow crystalline 2-amino-N,3,4,5,6-pentanitrotoluene was filtered off at the pump, air-dried, suspended in 96% sulfuric acid (50 ml) and cleaved to the free amine by stirring with anisole (1 ml) for 30 minutes at room temperature. Extraction with methylene chloride (5×75 ml) followed by drying over anhydrous magnesium sulfate and evaporation of the solvent afforded 2-amino-3,4,5,6-tetranitrotoluene (0.70 g), recrystallized from methylene chloride (ca 15 ml) as yellow crystals (0.42 g), m.p. 183°–185° (dec). The product was identical with that prepared in the previous example.

Peroxydisulfuric acid oxidation of the tetranitroaminotoluene produced by any of the examples above resulted in the production of pentanitrotoluene in high yield according to the method of the following specific example:

EXAMPLE 6

Pentanitrotoluene. To a stirred solution of 700 mg (2.2 mmol) of 4-amino-2,3,5,6-tetranitrotoluene in a mixture of 15 ml of 96% sulfuric acid and 30 ml of 20% oleum was added dropwise over 20 minutes 3.5 ml of 98% $H_2O_2$; the mixture was stirred at room temperature overnight. Extraction with methylene chloride (3×75 ml), drying over anhydrous magnesium sulfate and evaporation gave 710 mg of the desired pentanitrotoluene as a yellow solid. Recrystallization from chloroform (washed with sulfuric acid and distilled) gave 633 mg (82%) of yellow crystals: m.p. 224°–235° C. (lit. 225°–240°); NMR ($CDCl_3$), δ2.57 (S, 3, $CH_3$).

Anal. calcd. for $C_7H_3N_5O_{10}$: C, 26.50; H, 0.95; N, 22.08. Found: C, 26.64; H, 0.92; N, 21.97.

Obviously many modifications and variations of the present invention are possible in light of the above teachings. It is, therefore, to be understood that within the scope of the appended claims the invention may be practiced other than as specifically described.

What is claimed is:

1. Aminopolynitrotoluenes having four nitro radicals attached to the carbon ring.

2. Aminopolynitrotoluenes wherein the isomers thereof are selected from the group consisting of aminotetranitrotoluenes.

3. The compound 4-amino-2,3,5,6-tetranitrotoluene.

4. The compound 3-amino-2,4,5,6-tetranitrotoluene.

5. The compound 2-amino-3,4,5,6-tetranitrotoluene.

6. The compound 4-amino-N,2,3,5,6-tetranitrotoluene.

7. The compound 4-amino-N,2,3,5,6-pentanitrotoluene.

* * * * *